United States Patent [19]

Sterriker et al.

[11] 4,452,024

[45] Jun. 5, 1984

[54] WATER PENETRATION PREVENTING LOUVER

[75] Inventors: James Sterriker, Minnetonka; George Schlechter, Buffalo, both of Minn.

[73] Assignee: Industrial Louvers, Inc., Delano, Minn.

[21] Appl. No.: 18,180

[22] Filed: Mar. 7, 1979

[51] Int. Cl.[3] ..... E06B 7/08

[52] U.S. Cl. ..... 52/473; 98/121 R

[58] Field of Search ..... 52/473, 198; 98/121 R

[56] References Cited

U.S. PATENT DOCUMENTS

| | | | |
|---|---|---|---|
| 3,180,462 | 4/1965 | Grady | 52/473 X |
| 3,645,195 | 2/1972 | Koval | 98/121 R |
| 3,771,430 | 11/1973 | Lane | 52/473 X |
| 3,782,050 | 1/1974 | Dowdell et al. | 52/473 |
| 4,064,670 | 12/1977 | Lichtenwald | 52/473 |
| 4,103,468 | 8/1978 | Olsen | 52/473 |

*Primary Examiner*—Carl D. Friedman

*Attorney, Agent, or Firm*—Shoemaker and Mattare, Ltd.

[57] ABSTRACT

A louver in which some louver blades have water breaks for catching water that drops onto such louver blade from above. A top cap includes a lip portion which has an inwardly directed lower portion which directs water onto a louver located beneath the top cap.

7 Claims, 3 Drawing Figures

WATER PENETRATION PREVENTING LOUVER

BACKGROUND OF THE INVENTION

The present invention relates in general to means for controlling the flow of air into and out of a building, and, more particularly, to louvers.

In the construction of a building, there are certain areas which require the availability of fresh air. These areas usually are provided by defining a port in a building outside element, such as a wall, through which air moves into and/or out of the buidling. In order to properly modify the air flow through the port, and to protect the interior of the building from material passing thereinto from the building exterior, louvers are usually positioned in the building port.

As used herein, the term "louver" refers to an opening in a building wall or ceiling with slanted or sloping slats which allow sun and ventilation, but which exclude rain. The louver slats may be fixed or adjustable and may be any arrangement of fixed or adjustable slat-like openings which provide ventilation. Furthermore, as used herein, the term "louver blade" refers to the series of sloping slats which function to permit light and air to enter the building, but which are intended to exclude water infiltration into the building, and, especially, to shed rain water outward.

There are at least two basic criteria to be considered in the design of louvers. The first criterion is concerned with establishing proper air flow through the port, and the second criterion is concerned with preventing unwanted material, such as birds, water, debris, or the like, from passing through the port. Of the two cirteria, the first is generally considered to be the more important.

The establishment of proper air flow through the louver includes several considerations. For example, constriction of air flow through the port by the louver should be minimized. In other words, the percentage of the port opening that is restricted by the louver blades themselves should be minimized, so that pressure drop of the air passing through the port over the louver blades is as low as possible. Those skilled in the art will realize that any body placed in a flow stream will affect the pressure drop of the flow adjacent that body, and hence any louver blade will tend to restrict the opening and therefor create a pressure drop; however, a design consideration still should include minimizing this pressure drop.

Another consideration involved in the establishment of proper air flow through the port involves the prevention of water infiltration into the building. Ambient air may have varying amounts of moisture entrained therein due to many reasons, such as, for example, humidity, rain, fog, snow, or the like. When such moisture laden air strikes the louver blades, the moisture contained therein may tend to condense onto the louver blades or be carried into the building via the port. In designing the configuration of the louver blade itself, one of the primary purposes is to reduce or eliminate water infiltration. Water infiltration is generally determined by ounces per square foot of louver surface based upon wind velocity of varying speeds.

There are louvers designed to control the amount of water or moisture flowing into a building in the air passing through the port. A louver design includes an inwardly facing piece of metal on the upper front edge of the louver. This piece of metal allows the water that is running down the face of the building to be directed along the surface of the inwardly facing lip, and, when that water reaches the end of the lip, to drop off and fall into a trough formed in the topmost louver blade. The water is then carried back to the side of the louver to be transported away therefrom by a suitable drainage system. The back of the topmost louver blade is squared off so that none of the water on the upper blade can be blown into the inside of the louver. These louvers may also include louver blades which have a back lip for catching water.

However, it has been found through experimentation that when water runs off a surface above a louver blade, such as the lower surface of a superjacent louver blade, that water splashes and those splashes are carried into the interior of the louvered area by the air flowing through the louver. Thus, the splashes vitiate the effect of the moisture control device of those known louver blades because of the reinsertion of some moisture into the flowing air.

As used herein, the term "splashes" refers to that liquid caused to fly or scatter by the falling and striking of water against a surface, such as a louver blade. Thus, that mass of water generated by the falling and striking of water against a louver blade is referred to as either "splashes" or "droplets".

Accordingly, those louver blades having a front lip, while somewhat effective at controlling the moisture content of the air flowing into a building via the louver, are still unsatisfactory because these designs do not account for any moisture reinserted into the flowing air by the just-discussed splashing effect.

Other known louvers include inverted V-shaped blades which do not have the just-discussed front lips, and do not account at all for the just-discussed splashing effects. Still other known louvers include louver blades having V-shaped (see, e.g., U.S. Pat. No. 3,287,870) or inverted V-shaped ridges located near the middle thereof. However, these known blades are not effective to account for the droplets generated by the splashing of water onto the blade. Such droplets may fly upward from the blade high enough to clear the obstruction formed by the inverted ridge and to be carried thereover by the airstream. Furthermore, under certain conditions, water can flow over such a ridge and thereby obviate any effect of that ridge.

Another disadvantage of known louvers involves the bottom opening thereof. In known devices, the size of the rear opening is substantially larger than the front opening. This size differential results in an excessive amount of moisture being carried from the lowermost louver blade into the interior of the louver.

Accordingly, there is need of a louver which accounts for the droplets generated from water splashing when water falls onto a louver blade from above, and which will prevent water from circumventing any water catching device defined on the blade.

SUMMARY OF THE INVENTION

The device embodying the teachings of the present invention accounts for that water splashing onto the surface of a louver blade from above. The louver of the present disclosure includes intermediate louver blades which have a water break defined therein. That is, a lip is defined in the blade which faces outwardly of the building. The lip defines a channel which is sized, positioned and shaped to catch droplets generated when water from above the blade impacts that louver blade.

The water break thus picks up the water that is splashing off the louver blade and catches that water before it can be blown through the louver by the flowing airstream.

Water infiltration in the presently disclosed device is approximately one-half of one-tenth of an ounce per 15 minutes of time duration with a wind velocity of 1,200 feet per minute, while the pressure drop across the presently disclosed louver remains unchanged from that of known louvers. Thus the louver of the present invention has a water infiltration rate which is lower than any known louvers, especially at high air velocities. Thus, less water will infiltrate a building having the presently disclosed louver than a building having prior louvers.

Furthermore, the device of the present invention has means, such as a screen, mounted thereon for preventing large objects, such as birds, or the like, from entering the building via the port.

Water is caught by the water break, and the lip prevents any water from flowing out of the water break toward the inside of the building. Thus, the water cannot circumvent, or overcome, the water break.

The louver of the present disclosure further includes an occluder means for making the rear opening of the louver approximately the same size as the front opening in the lower part of the louver, or in an alternative embodiment, just slightly larger than such front opening. Thus, water infiltration near the bottom of the louver is minimized.

As compared to prior louvers, the pressure drop from the outside to the inside in the present louver is low. Pressure drop is important because pressure drop determines how much the air pressure is being restricted by the louver design. The louver blade design of the present invention allows setting a louver blade at a 35 degree angle to the horizontal, thereby allowing for a freer passage of air, yet with a lower amount of water infiltration. It is noted that the just-mentioned 35 degree angle is preferred, but not restrictive. To illustrate the effects of louver blade angles, consideration is directed to a louver having the blades set in a horizontal position, such orientation achieving maximum air passage with minimum restrictions. In order to obtain limited water infiltration the angles of the louver blades can be adjusted from a flat horizontal position to a semi-vertical position. As the angle is increased from the horizontal line the amount of pressure from the outside to the inside of the louver blade is also increased. At some point an angle is reached which produces satisfactory results from a water infiltration standpoint without a total restriction of the louver opening. Because of the design of the louver embodying the present invention, it is possible to have the blade at a smaller angle to the horizontal thereby having a lesser pressure drop.

Since the blades in the presently disclosed louver are at a lesser angle, it is possible to obtain more free air space. This is accomplished by both the spacing of the blades and the angle of each blade to horizontal.

Since the louver design of the present invention enables the blade to be at an angle to horizontal which is smaller than in prior louvers, there is less re-circulation and turbulence in the air in use. The slope of the louver blade and the amount of water infiltration is obtained by the combination of all the factors involved. One of the important factors is that the water coming off the face of the building is diverted inwardly by a lip so that water falls into the top trough member and does not proceed down the face of the louver itself. Furthermore, the inwardly diverting lip in combination with an upper trough causes a substantial portion of the water impinging on the louver to be diverted from the face of the louver. Without the inwardly directed lip, or with a straight lip, water hitting the surface of the building would cascade down over the face of the louver itself. By diverting the water along the tongue of the louver, that water falls onto the uppermost blade and is carried to the side and is transported down water gutters in side caps to the bottom of the louver.

The front rearward facing member at the face of the presently disclosed louver thus provides important advantages thereto because the water is directed inward onto the surface of the upper louver blade, which advantages are not possessed by prior louvers. Also, a trough member of the present louver is included and does not allow the airstream to be carried up into the louver opening, but the airstream and water contained therein is kept within the cavity formed by the trough member and the water falls back onto the upper face of the upper louver blade and is diverted to the louver drainage system.

OBJECTS OF THE INVENTION

It is, therefore, a main object of the present invention to prevent water infiltration through a louver into a building. It is another object of the present invention to prevent droplets generated by water splashing onto a louver blade from above from infiltrating into a building It is yet another object of the present invention to prevent water from overcoming a water break defined in a louver blade. These together with other objects and advantages which will become subsequently apparent reside in the details of construction and operation as more fully hereinafter described and claimed, reference being had to the accompanying drawings forming part hereof, wherein like reference numerals refer to like parts throughout.

DETAILED DESCRIPTION OF THE INVENTION

Figure 1:
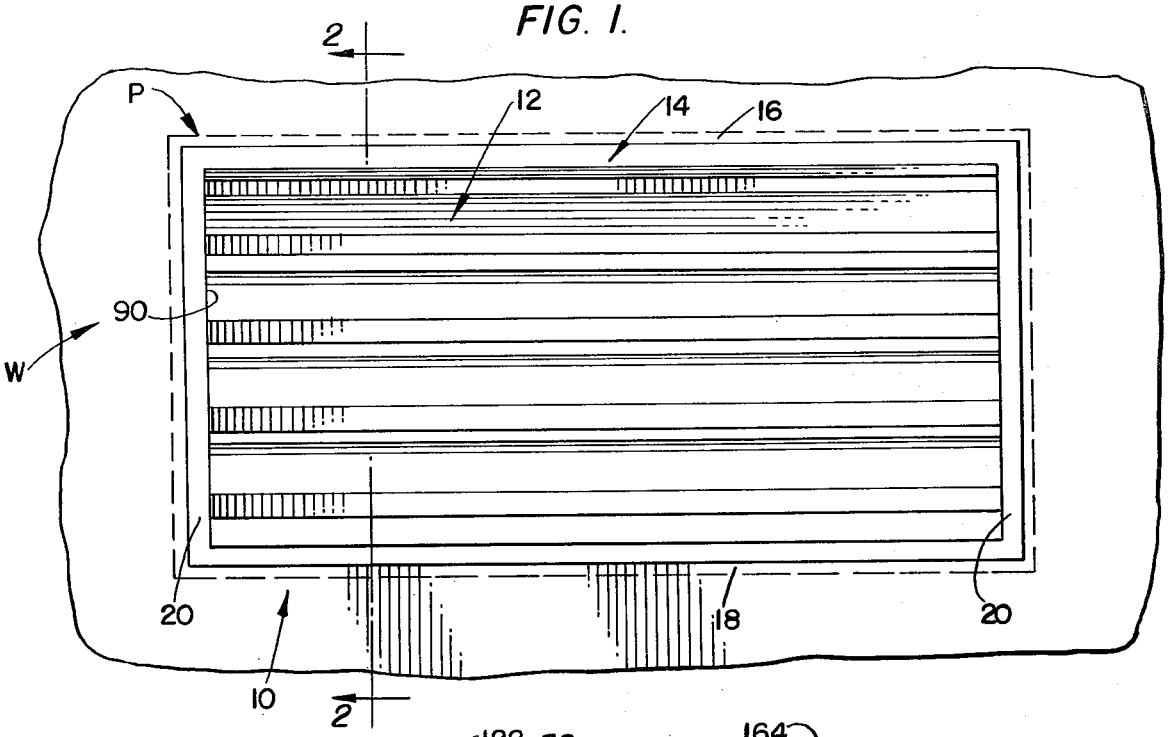
FIG. 1 is an elevation of a port having a louver embodying the teachings of the present invention.

Shown in FIG. 1 is a building air portal P defined in an external building structure such as wall W. The air portal provides a passage for fresh air into the building from the outside, and also defines a path for the passage of air from the building to the outside environment. A louver 10 is mounted in the portal, and, as shown in FIG. 1, includes a plurality of louver blades 12 each mounted in a frame element 14 having a top cap 16 and a bottom cap 18, and side caps 20 which are each attached to each other and to the building wall in a usual manner.

Figure 2:
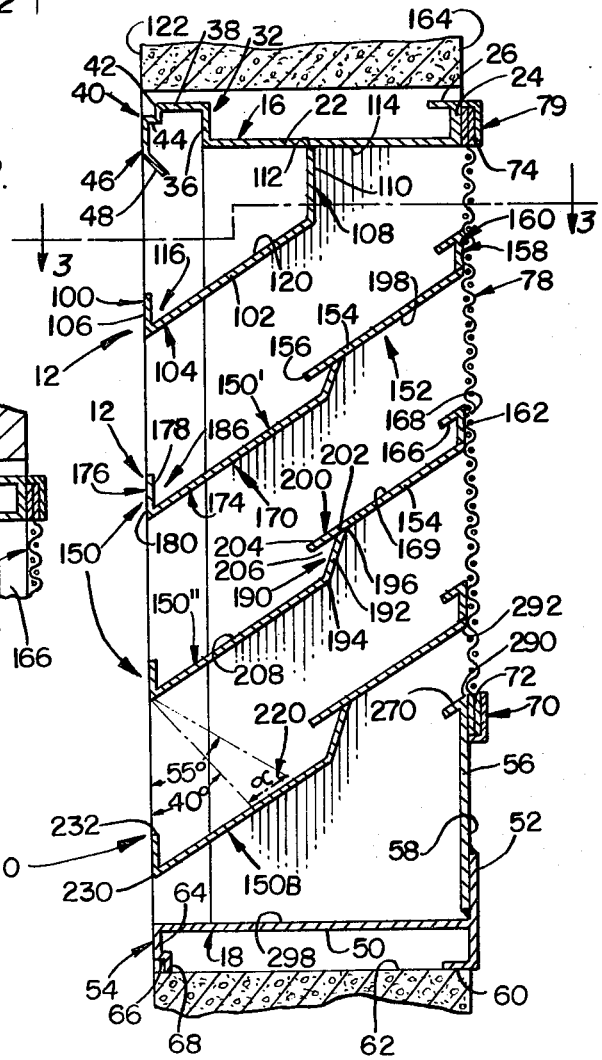
FIG. 2 is a side elevation taken along line 2—2 of FIG. 1.

As shown in FIG. 2, the top cap 16 includes a web portion 22 flushly mounted against the portal defining portion of the wall, a first side flange 24 having an inturned anchoring tongue 26 embedded in the wall, and a second side flange 32 having a first flange 36 and a second flange 38 integrally connected together and to the web portion 22 to define a second side of the cap portion 16. A stepped flange 40 depends from the end of the second flange 38 which is remote from the end thereof connected to the first flange. The stepped flange has a first portion 42 connected to the flange 38 and a second portion 44 connected to the first portion. A lip 46 is connected to second portion 44 and has a lower portion 48 thereof which depends inwardly of the portal from the second portion. It is noted that the lip 46 and the portion 48 are one continuous member to allow for the co-efficient of friction or adhesion of the water to the surface to be continuous so that the water is diverted inwardly along the angle face 48.

The bottom cap 18 is shown in FIG. 2 to include a web portion 50, a flange 52 on one side thereof and a depending flange 54 on the other side thereof. Flange 52 will be discussed in greater detail below.

The flange 52 is attached to the outside surface 58 of a depending section 56, as by fastening, welding, or the like. The flange 52 includes an inturned flange 60 which rests on a surface 62 of the wall to thereby mount the cap 18 to the wall. The opening in the building wall is constructed to have a size slightly larger than the louver unit, and the louver unit is slid into that opening, shimmed into place and grouted and otherwise attached to the building. It is noted that the areas formed by the top and bottom caps are void. A caulked bead can be inserted in the leg portions defined by the flanges on the caps. The flange 54 includes a first portion 64, a second portion 66 connected thereto and a third portion 68 connected to the second portion. The flange 54 is therefore stepped and is mounted on the wall to thereby further anchor the cap 18 thereto. A slot defining flange 70 is mounted on the outside surface 58 of flange 52 and has a slot 72 which is vertically aligned with a slot 74 in the flange 30 to receive a screen 78 or other such device. The screen 78 is attached to the back of the louver assembly by a suitable attaching means 79. The screen serves the usual purpose of covering the portal to prevent large objects, birds, insects, or the like, from entering the building via the portal P. Member 56 operates as a filler member between the screen and the flange 52 and acts as a water stop while not restricting air movement through the bottom opening.

Figure 3:
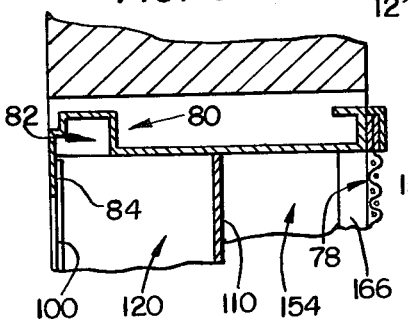
FIG. 3 is a view taken along line 3—3 of FIG. 2.

A drainage system 80 is associated with the louver 10 and is best shown in FIG. 3 to include a channel 82 which allows the water to run down the inside of the side cap to the bottom of the side cap. The water then runs out of the bottom of the louver through an opening on the upper surface of the bottom cap 18. The side cap member 20 is similar to the top cap 16, with the exception that there is no inwardly facing lip 48 as member 46 extends in a straight line. This construction allows water to run down the channel 82 which thus forms a water gutter. Water from the louver thus flows from the top surface of the louvers, such as top surface 120, into the water gutter 82 for disposal. The water is conducted from the louver 10 to a disposing location and thus entry of water into the building via the portal P is vitiated, if not entirely prevented. The drainage system 80 can include a front lip 84 as shown in FIG. 3.

The louver blades 12 are elongate and extend across the portal P as shown in FIG. 1. The louver blades are each end connected to the side caps. The louver blades are thus shown in FIG. 2, and attention is directed thereto for the following description thereof. As shown in FIG. 2, there are a plurality of louver blades 12, and this plurality of blades includes a top blade 100 which is generally C-shaped and has a web section 102 with a front lip 104 defined by a front flange 106 on one side thereof and a back lip 108 defined by a back flange 110 on the other side thereof. The front and back lips are in spaced parallelism with respect to each other, and the web portion is forwardly depending from the back flange to the front flange. The back flange has an upper terminal edge 112 attached, as by welding, or the like, to undersurface 114 of the top cap 16 to further connect the top louver blade to the frame 14. The front lip 104 and the web section define a channel 116 which is fluidly associated with channel 82 of the drainage system 80 for conducting water thereinto. Water impinging or condensing on the louver blade upper surface 120 from moisture in the air, such as rain, snow, fog, or the like, is conducted into the channel 116 by the declining nature of the web section, and from that channel into the drainage system. Water is prevented from passing into the building from the portal by the back flange 110. It is also noted that water flowing down the building front surface 122 will tend to move onto the web section 102 because of the influence exerted thereon by the depending lip 46. The water will then be conducted into the drainage system instead of passing in front of the portal and thus become entrained in or otherwise influencing air flow into or out of the building via the portal.

The plurality of louver blades also includes a plurality of intermediate louver blades 150 which are also shown in FIGS. 1 and 2 to be elongate and end connected to the frame side caps. The louver blades 150 are each bipartite, and each blade 150 includes a J-shaped rear section 152 having a planar leg 154 which has a free terminal edge 156 on one side edge thereof and a back flange section 158 defining a back lip 160 on the other side thereof. The rear section 152 thus includes a first upright flange 162 connected at one side thereof to one edge of the planar leg 154 and extending upwardly therefrom to be oriented to have the outside surface 168 thereof vertically aligned with the inside surface 164 of the building adjacent the portal. A second flange 166 is connected at one side thereof to the other side edge of the upright flange 162 and extends outwardly of the building to be oriented in spaced parallelism with respect to the leg 154. The back lip 160 defines a water stop which catches water running on the upper surface 169 of the planar leg 154 to prevent such water from entering the building via the portal. As shown in FIG. 2, the louver blades 150 are each oriented so the planar leg 154 thereof is sloped downwardly toward the outside of the building. Thus, any water on the louver blades 150 will have a gradient tending to carry such water out of the building.

With reference to FIG. 2, it is seen that the top of the louver is totally enclosed because of flange 110. For this reason, water infiltration control in the presently disclosed louver is superior to prior louvers as a substantial portion of the water is diverted by the lip 48 into the top channel member thereby not crossing the face of the louver. With the top channel member being totally enclosed, there is no opportunity for this water to be carried into the building. On the other blades of the louver 10, the design of the blade and the forward extension of edge 156 creates a situation that when the air strikes the louver blade and is carried around the C-shaped member, the air is diverted directly back onto the louver blade and the water contained in that air is not diverted or allowed to be diverted up into the airstream itself above the surface of leg 154.

Also, by placing the catch area near the midpoint of the louver blade, the water that strikes the louver blade with the greatest velocity, which would be the water falling off of the surface of the blade above the upper sufface of the blade, strikes the lower blade immediately adjacent the catch members and the splashing water does not get up into the airstream quickly enough to clear the front of the upper leg 154 extended at 156.

Each of the louver blades 150 also has a C-shaped front section 170 which includes a planar web section 174 which is in spaced parallelism and is offset from the planar leg 154. The front section 170 has an upright front flange section 176 defining a front lip 178 which is located to have the outer surface 180 thereof vertically aligned with the building outside surface 122 and the front lip 104 of the top louver blade 100. The front lip 178 and the web section 174 define a channel 186 which is fluidly associated with the drainage system to conduct water accumulating on the web section 174 thereinto. As with the top louver blade, the intermediate louver blades are inclined outwardly of the building so that water collected in the web section 174 is urged toward the channel 186 of each louver blade. A rear flange section 190 defines a rear flange 192 and is connected at one edge thereof to one edge 194 of the web section and at the other edge 196 thereof to the lower surface 198 of the rear section 152 at a location spaced from the free terminal edge 156 of that section. The flange 190 is planar and is inclined outwardly of the building.

Thus, the louver blades are inserted into the side caps so that they are adjacent the channel opening at the lower end of the louver blade adjacent to channels 186 and 116. Water is then carried in these channels to the side of the louver to the side caps, the water freefalls through the channel or water gutter to the bottom side cap and runs out of the side cap over surface 54 down the front of the building.

As shown in FIG. 2, web section 174 is in spaced parallelism with respect to the leg 154 of the rear section 152. An overhang 200 is defined by that portion of leg 154 located between the free edge 156 and attachment point 202 of the edge 196 of the flange 192 and the leg 154. The overhang thus includes a lip 204 extending outwardly of the building. The flange 190 and the lower surface 198 of the leg 154 define a channel 206 which captures any water flowing on the upper surface 208 of the web section 174 inwardly of the building. As will be discussed below, the water collected on the web section 174 has a component thereof formed as a result of water dropping off the superjacent louver blade. The channel 206 thus serves as an intermediate catcher or water break and catches water that is splashing off of that louver blade before that water is blown into the building by the flowing airstream, and prevents water from being conducted into the building by the louver blades 150.

The front louver blade section 170 is shown in FIG. 2 to be downwardly offset from the rear section 152, and both sections are forwardly inclined toward the front of the louver. Thus, any water captured by the back lip 160 or the water break of each blade will tend to flow back toward the outside of the building and into the water drainage system 80. The forwardly sloped orientation of the flange 190 defines a surface which induces any water captured by the water break to flow toward the front lip. The angle of inclination and the dimensions of the flange 190 as well as the overhang 200 are selected to provide the proper gradient to the water captured in the channel 206 in relation to any other gradient exerted on the water tending to drive such water into the building, or toward the back lip of the louver blade. The angle of inclination of the flange 190 and the depth of channel 206 as defined between the lower surface 198 of the leg 154 and the upper surface 208 of the web 174 is selected to insure that any splashes created by the impacting of water onto the web 174 will be caught by the water break. Thus, the overhang 200 is spaced far enough from the surface 208 to insure such droplet capture for any rain and any wind conditions to which the building may be subject.

It is also noted that the overhang 200 prevents water from flowing over the water break and thereby overcoming and defeating that water break. The water may flow up the inclined portion in some circumstances, but will not be able to clear the overhang 200.

The lips and water break thus inhibit or eliminate water infiltration into a building via a louver 10.

It has been found that the maximum area of water contact on a louver blade is at a point on that blade which is determined by taking the most outward and lowest point on the superjacent blade and drawing a line at an angle of 40° from a vertical front surface of the superjacent blade to an intersecting point on the louver blade of interest and a line from the same point on the superjacent blade at an angle of 55° from a vertical front surface of the superjacent louver blade to an intersecting point on the blade of interest. The impact area just discussed for the water is denoted in FIG. 2 by the reference numeral 220, and is the base of a generally conical area having an apex angle $\alpha$ of 15°. The impact area 220 is the area of maximum water contact from water laden air being carried through the louver. Immediately behind this critical area 220, the water catching lip 204 of the water break is located, which in this particular instance is C-shaped. The water break thus picks up the water that is splashing off the louver blade and catches that water before it can be blown up into the airstream and through the louver. It is also noted that the web section 174 used in this example and shown in FIG. 2 is oriented to be at an angle of 35° with respect to the horizontal. Also, in the preferred embodiment, the intermediate louver blades 150 are separated by approximately 3-7/16 inches at edges 230, and the front lips are approximately ¾ inches thick as measured between edge 230 and free edge 232 thereof. The louver 10 is approximately 6 inches thick as measured from the front surface 180 of the front lips 178 to the back surface 168 of the back lips 158. Thus, the water break on louver blade 150' catches splashes generated by the water dropped onto the louver blade 150' from the top louver blade 100, the water break on the louver blade 150'' catches splashes generated by the water dropped onto that louver blade from the louver blade 150', and so forth.

Due to the forwardly inclined nature of the louver blades, the area between bottom cap 18 and the front lip of the lowermost louver blade 150B is smaller than the area between that cap and the back lip of the blade 150B. To prevent water infiltration via a path between the bottom cap and the blade 150B, the back flange 52 is extended upwardly as shown in FIG. 2. The flange 52 occludes the area between the bottom cap 18 and the back lip of the blade 150B, and includes an inturned flange 270 which is forwardly sloped to be essentially parallel with the flanges 166 of the louver blades. The flange 52 thus serves the function of preventing water infiltration into a building in a manner similar to the back lips of the louver blades. The area above the top 290 of the flange 52 and edge 292 of blade 150B is essentially equal to, or slightly greater than, the area between edge 230 of that louver blade and the bottom cap upper surface 298. By making the rear opening the same size as the front opening, or in an alternative embodiment, just slightly larger than that front opening, water infiltration is minimized without affecting the air passage through the louver.

As this invention may be embodied in several forms without departing from the spirit or essential characteristics thereof, the present embodiment is, therefore, illustrative and not restrictive, since the scope of the invention is defined by the appended claims rather than by the description preceding them, and all changes that fall within the metes and bounds of the claims or that form their functional as well conjointly cooperative equivalents are, therefore, intended to be embraced by those claims.

We claim:

1. A louver for use in a port in a building, comprising:
a top cap including a central section;
a flange section on one edge of said central section, said flange section including a first portion attached to said central section and extending downwardly, and a second portion attached to said first portion to be angled inwardly toward said central portion and downwardly therefrom for providing a path over which water can flow upon impinging on said first portion, said water being directed inwardly in the direction of said central section by said second portion;
a C-shaped top blade having a back flange attached to said top cap central section and depending therefrom, a web section attached to said back flange and extending forwardly therefrom, and a lip on said web section, said web section being located beneath said top cap to collect water draining from said top cap second portion so that water draining from said top cap is collected by said top blade and prevented from entering a port; and
an intermediate louver blade in the port and located beneath said top blade, said intermediate louver blade including a longitudinal centerline and a C-shaped section located adjacent a front portion of the port and having a planar web section and an upturned flange on one side of said web and an upwardly and rearwardly slanted flange on an opposite side of said web, and a J-shaped section located adjacent the rear portion of the louver and which includes a planar leg having a free side and an upturned flange on an opposite side of said leg, said web being offset beneath said planar leg and in spaced parallelism therewith, said slanted flange being connected to said planar leg at a location spaced from said free side to define a lip overhanging said slanted flange and located near said longitudinal centerline; and
a drainage system associated with said top blade lip and said intermediate louver blade upturned flange for conducting water away from said blades.

2. The louver blade defined in claim 1 further including a screen covering the port.

3. The louver defined in claim 1 wherein the port has a front opening and a rear opening and further including an occluding means for closing the rear opening of the port so that the port rear opening essentially is the same size as the port front opening near the bottom of the port.

4. The louver defined in claim 3 further including a screen covering the back of the louver and mounted on said occluding means.

5. The louver defined in claim 1 wherein said C-shaped section is oriented at an angle of about 35° with respect to the horizontal.

6. The louver defined in claim 1 wherein said louver blades are transversely inclined.

7. A louver for use in a port in a building, comprising:
a top cap including a central section;
a flange section on one edge of said central section, said flange section including a first portion attached to said central section and extending downwardly, and a second portion attached to said first portion to be angled inwardly toward said central portion and downwardly therefrom for providing a path over which water can flow upon impinging on said first portion, said water being directed inwardly in the direction of said central section by said second portion;
a C-shaped top blade having a back flange attached to said top cap central section and depending therefrom, and a web section attached to said back flange and extending forwardly therefrom, and a lip on said web section, said web section being located beneath said top cap to collect water draining from said top cap second portion so that water draining from said top cap is collected by said top blade and prevented from entering a port; and
an intermediate louver blade in the port and located beneath said top blade, said intermediate louver blade including a longitudinal centerline and a C-shaped section located adjacent a front portion of the port and having a planar web section and an upturned flange on one side of said web and an upwardly and rearwardly slanted flange on an opposite side of said web, and a J-shaped section located adjacent the rear portion of the louver and which includes a planar leg having a free side and an upturned flange on an opposite side of said leg, said web being offset beneath said planar leg and in spaced parallelism therewith, said slanted flange being connected to said planar leg at a location spaced from said free side to define a lip overhanging said slanted flange and located near said longitudinal centerline, an impact area in which water from above strikes that blade, said impact area being defined to be bounded by a first line which intersects a lowermost section of a superjacent louver blade and is oriented at about 40° with respect to the vertical and a second line which intersects that superjacent blade lowermost point and is oriented at about 55° with respect to the vertical, and said planar leg free side being spaced toward said blade rear with respect to said impact area so that said J-shaped blade section includes less than one-half of said blade and said overhanging lip is located closer to the rear of said blade than to the front of said blade whereby a water catch is defined which catches substantially all of the water impacting said intermediate blade in and around said impact area from a superjacent blade; and
a drainage system associated with said top blade lip and said intermediate louver blade upturned flange for conducting water away from said blades.

* * * * *